United States Patent [19]

Jenny et al.

[11] Patent Number: 4,768,728

[45] Date of Patent: Sep. 6, 1988

[54] METHOD AND APPARATUS FOR REWINDING A THREAD

[75] Inventors: Rudolf Jenny; Bruno Traber, both of Horgen, Switzerland

[73] Assignee: Maschinenfabrik Schweiter, Horgen, Switzerland

[21] Appl. No.: 25,875

[22] Filed: Mar. 16, 1987

[30] Foreign Application Priority Data

Mar. 17, 1986 [CH] Switzerland ..... 1073/86

[51] Int. Cl.[4] ..... B65H 59/38

[52] U.S. Cl. ..... 242/45; 242/36

[58] Field of Search ..... 242/45, 36, 39, 18 R, 242/54 R, 75.5, 75.51

[56] References Cited

U.S. PATENT DOCUMENTS

| | | | |
|---|---|---|---|
| 3,785,582 | 1/1974 | Girard | 242/39 |
| 3,905,560 | 9/1975 | Trifunovic et al. | 242/45 X |
| 4,019,691 | 4/1977 | Wroclawski et al. | 242/45 |
| 4,049,211 | 9/1977 | Spescha | 242/45 |
| 4,158,445 | 6/1979 | Newbegin | 242/39 |
| 4,330,094 | 5/1982 | Mayer | 242/36 |
| 4,458,849 | 7/1984 | Miyake et al. | 242/36 |
| 4,494,702 | 9/1985 | Miyake et al. | 242/36 |
| 4,629,137 | 12/1986 | Schippers et al. | 242/45 |
| 4,650,133 | 3/1987 | White et at. | 242/45 |

*Primary Examiner*—Stanley N. Gilreath

*Attorney, Agent, or Firm*—Helfgott & Karas

[57] ABSTRACT

The tension in the rewound thread is modified in programmed manner as a function of the residual thread length still on a copy, the residual thread length being determined from the difference between the total thread length on the copy and the thread length already unwound from the cop. The total thread length on a cop is calculated from the weight of the thread and a calculation factor length per thread weight. For this purpose, the apparatus for performing the method has a weighing cell, which is connected to the control unit of the rewinding means. During the complete rewinding process, the rewinding speed can be kept close to the limit beyond which thread breaks increasingly occur.

8 Claims, 1 Drawing Sheet

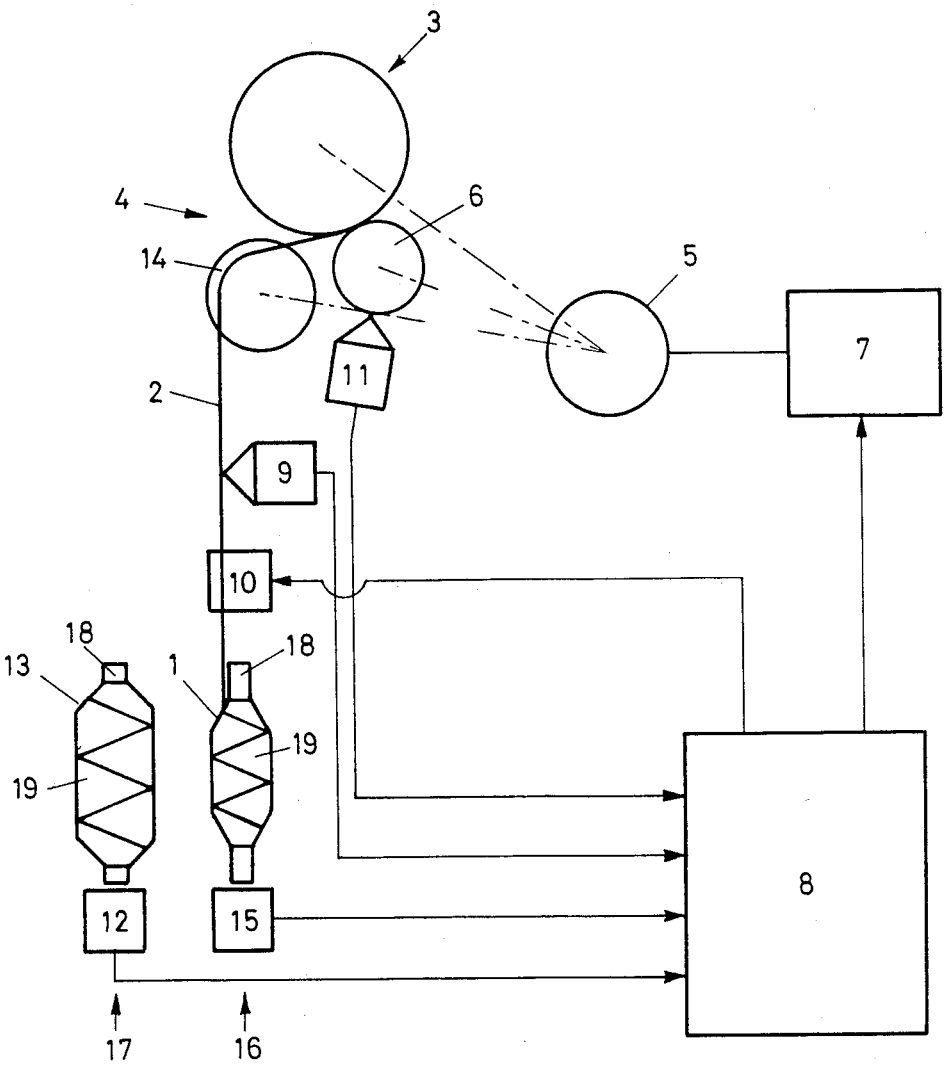
3
4
6
14
5
7
11
2
9
10
18
13
1
18
19
19
8
12
15
17
16

METHOD AND APPARATUS FOR REWINDING A THREAD

BACKGROUND OF THE INVENTION

The present invention relates to a method and to an apparatus for rewinding a thread.

When rewinding a thread, e.g. from a spinning cop onto a winding bobbin, the thread is placed by a thread laying unit on the bobbin surface. The winding bobbin is driven by a drive motor.

In practice, where several cops are successively rewound, a maximum production rate is sought. An increase in the production rate is obtained by increasing the winding speed without any increase in the number of thread breaks. If the winding speed exceeds a certain limit, there is an increase in the number of thread breaks and as a result an upper production rate limit is set. The higher the winding speed, the greater the tension in the thread, which explains the increase in thread breaks on increasing the winding speed.

If the winding speed is kept constant, it can be observed that the thread tension at the start of the rewinding of a cop is low. This is followed by a slow increase in the thread tension and towards the end of the rewinding process it rises rapidly. To prevent thread breaks occurring in the final phase of the rewinding process, the winding rate throughout the rewinding process is reduced to such an extent that during the final phase of the rewinding process, which is much shorter than the preceding rewinding period, a minimum number of thread breaks occurs. However, the consequence of this is that throughout said greater rewinding period, rewinding takes place slowly. Thus, in order to increase the production rate, the speed at which the thread is removed from the spinning cop is high. However, due to the constructional characteristics of spinning cops, the unwinding speed of the thread at the start of cop (full cop) and therefore the thread tension cannot be made too high, because otherwise complete layers or loops of thread would be drawn off.

Thus, to increase the production rate, it must be possible to modify the winding speed during the drawing off of the thread from a cop or spinning cop so as to ensure that throughout the rewinding process the thread tension is as near as possible, but remains below, a limit above which thread breaks frequently occur.

To achieve this, it is known to constantly adjust the speed of the drive motor in response to certain factors, which are e.g. the thread speed and thread tension. The magnitude of the thread tension can be controlled as a function of the winding-up time by a corresponding program, the diameter of the winding bobbin, the cop unwinding time or a combination of these quantities.

In order to achieve this type of control, it is e.g. known to make use of a thread tension meter, which continuously measures the thread tension. In the case of deviations between a constant or programmed adjustable desired or rated value and the actual thread tension value, the drive motor speed is adjusted in such way that the deviation is reduced. In the case of short-term deviations, it is possible to control an electronically operable thread braking means with the aid of an electronic control system in such a way that the deviation is reduced. The control signal used for this purpose can additionally be compared with a given desired value. When deviations occur between the instantaneous control signal and the desired value, the drive motor speed is adjusted with the aid of the electronic control system so that said deviation is reduced. However, this known method still does not permit the presently required increase in the production rate in the case of partly unwound cops.

SUMMARY OF THE INVENTION

The problem of the present invention is to propose measures making it possible to increase the production rate over and beyond the hitherto conventional limit.

In accordance with the principles of the invention, both method and apparatus are disclosed wherein thread is rewound from a spinning cop onto a winding bobbin driven by a variable speed motor. The length of thread removed from the cop is continuously measured and the residual length of thread remaining on the cop is determined. The speed of the motor is varied in accordance with the residual length in order to maintain optimum speed of winding and thread tension without causing thread breakage.

The aforementioned objects and advantages of the invention as well as other objects and advantages thereof will either be explained or will become apparent to those skilled in the art when this specification is read in conjunction with the accompanying drawings and specific description of preferred embodiments which follow.

BRIEF DESCRIPTION OF THE DRAWING

The accomanying single figure of the drawing diagrammatically illustrates a preferred embodiment of the invention.

DETAILED DESCRIPTION OF PREFERRED EMBODIMENTS

In the drawing the represented thread rewinding apparatus contains a first bobbin 1, which is also referred to here as a pattern or spinning cop and from which the thread 2 is removed. Thread 2 then passes onto a second bobbin 3, which is referred to here as the winding bobbin. Between these two bobbins 1 and 3 is provided a thread laying unit 4, with the aid of which the thread 2 is laid or placed on the surface of winding bobbin 3. This thread laying unit 4 can e.g. contain a grooved drum or a thread guide and in the represented embodiment unit 4 has a grooved drum 14. Winding bobbin 3 is connected to a drive motor by its shaft. However, the driving bobbin 3 can also be circumferentially driven by means of a drive roller 6 or the grooved drum 14. The speed of motor 5 is regulated by a speed regulator 7, which is connected to an electronic control unit 8. The latter can contain a microprocessor, which in programmed manner can control the sequences in said apparatus.

Over the path travelled by thread 2 between spinning cop 1 and thread laying unit 4 are provided a thread tension meter 9 and an electrically operable thread braking means 10. Information on the tension in the rewound thread 2 is supplied by meter 9 to control unit 8 and, if necessary, braking means 10 can be activated by said control unit 8. A thread length sensor 11 is provided for the continuous measurement of the length of the thread unwound from cop 1. To control the unwinding speed of the thread, it is necessary to accurately know throughout the rewinding process the length of the thread still located on spinning cop 1.

The cop 1 from which the thread 2 is removed is located in the first station 16 of the apparatus, which is also referred to as the main station. Spinning cop 1 represented in said main station 16 has a winding 19 on a bobbin 18. A given length of thread 2 has already been removed from winding 19 of cop 1. This representation of spinning cop 1 shows a possible state of winding 19 during the operation of the present apparatus. The latter is contructed in such a way that it makes it possible to introduce and process a spinning cop 1 in main station 16 from which a part of the spinning winding 19 has already been removed, in which the bobbin 18 has not been completely wound up, in which the bobbin 19 has not been correctly wound, or the like.

Upstream of the main station 16 is provided a further station 17 of the apparatus, which is also referred to here as the upstream station. Upstream station 17 is intended to temporarily receive a further spinning cop 13. This is a spinning cop 13, which replaces the empty bobbin 18 in main station 16 after thread 2 has been removed from the first spinning cop 1 in said station 16. The upstream station 17 contains a first weighing cell 12, on which rests the second pattern 13. The output of weighing cell 12 is connected to control unit 8. Another weighing cell 15 can be located in main station 16, the first cop then resting on the second weighing cell 15.

The basic idea of this invention is to control the rewinding speed in such a way that the thread tension remains as constant as possible during the removal of the thread from a spinning cop and that said thread tension is as close as possible to a limit above which thread breaks frequently occur.

The thread tension value representing said tension limit is an empirical value and is known for the particular thread type. It is also known that there is a direct proportional ratio between the thread speed and the thread tension, i.e. thread tension increases with increasing speed. In order to be able to solve the set problem in the represent case, the control unit 8 must keep the thread speed, i.e. the removal speed of thread 2 in the range below the tension limit and control same in such a way that the thread tension does not reach the tension limit.

The diameter and the relevant quality characteristics of the particular thread 2 to be rewound are known before hand or can be easily established. Thus, conclusions can be drawn concerning the length of the thread to be rewound on the basis of the weight of the spinning cop 1 or 13. This weight is determined in upstream station 17 by weighing cell 12 and supplied to control unit 8, which stores this weight until the start of the removal of thread 2 from spinning cop 13. At the start of the removal of thread 2 from a spinning cop 1, 13, et., the thread length meter 11 is set to zero and during thread removal it then continuously provides details on the length of the already removed thread.

If the weight of bobbin 18 is subtracted from the weight of the spinning cop 1 or 13, then the weight of the thread 2 on bobbin 18 is obtained. As the quality features of thread 2 are known, it is possible to establish therefrom the length of the thread 2 forming winding 19. The total thread length on a cop 1 or 13 is calculated from the weight of the thread and a calculation factor length per thread weight. Conclusions can be drawn regarding the residual thread length from the result of a subtraction of the length of the already removed thread measured by the thread length meter 11 from the calculated total thread length on winding 19. This residual length is then decisive for controlling the rewinding speed through control unit 8, because it indicates to what extent the rewinding has progressed at the particular instant and therefore how great the thread tension at the corresponding time can be.

At the end of the removal of thread 2 from cop 1 in main station 16, the now empty bobbin 18 is removed therefrom, the next cop 13 is moved from upstream station 17 into main station 16, thread length sensor 11 is set to zero and the rewinding process can start, on the basis of the stored weight of cop 13.

This makes it possible to modify the desired thread tension in program-controlled manner and as a function of the residual thread length still on cop 1. The rewinding speed can be made high during the first and longer phase of rewinding and is only reduced towards the end of the rewinding process, to ensure that no thread breaks occur in this phase. There is no increased number of thread breaks even if there is a significant difference between the length of the thread 2 forming winding 19 and the remaining thread length in said winding.

Control unit 8 can be constructed in such a way that it permits an optimization of the rewinding process if rewinding is to take place of a number of spinning cops containing thread of the same quality. This further possibility of increasing the production rate involves optimizing the conditions of the rewinding process with an increasing number of rewound spinning cops. This can be achieved in that the length of the thread removed from the first spinning cops is determined and associated with the particular residual length. Any thread breaks which occur, e.g. determined by the thread length sensor 11 are detected by the control unit 8 and associated with the particular thread length or length range in which they occurred. On the basis of the frequency with which the thread breaks occur at a particular thread length, it is possible to correct the speed at which the thread was rewound in this length range during the treatment of the following spinning cops. If thread breaks occurred, this correction takes place towards lower thread speeds, whereas it is towards higher speeds if no thread breaks have hitherto occurred at this thread length. With an increasing number of treated spinning cops, it is possible to achieve a better approximation to said thread tension limit.

For a similar purpose, the total length of the thread can be subdivided into a number of partial lengths, with each of which is associated a given thread tension resulting from the treatment of the preceding cop. Although approximation to the thread tension limit is not optimum with this subdivision into partial lengths, the necessary apparatus expenditure in the rewinding means is certainly lower.

While the fundamental novel features of the invention have been shown and described and pointed out, it will be understood that various substitutions and changes in the form of the details of the embodiments shown may be made by those skilled in the art without departing from the concept of the invention as limited only by the scope of the claims which follow.

What is claimed is:

1. A method for rewinding thread from a spinning cop onto a winding bobbin driven by a variable speed driving motor, the original length of thread on the cop prior to rewinding being known, wherein the tension on the thread increases with increasing winding speed which comprises the steps of:

continuously measuring the length of thread removed from the cop;

subtracting the length so measured from the original length to determine the residual length of thread remaining on the cop; and varying the speed of the motor in accordance with the residual length in order to maintain optimum speed of winding and tension without causing thread breakage.

2. A method for rewinding thread from a spinning cop onto a winding bobbin driven by a variable speed driving motor wherein the tension on the thread increases with increasing winding speed which comprises the steps of;

determining the original length of thread on the cop prior to rewinding;

continuously measuring the length of thread removed from the cop;

subtracting the length so measured from the original length to determine the residual length of thread remaining on the cop; and varying the speed of the motor in accordance with the residual length in order to maintain optimum speed of winding and tension without causing thread breakage.

3. A method as set forth in claim 2 wherein the original length of thread on the cop is determined by first determining the weight of the thread by subtracting the weight of the empty cop from the weight of the cop with the thread wound on it and then computing the original length of thread from the determined weight and a predetermined calculation factor length per thread weight.

4. Apparatus for rewinding thread from a spinning cop onto a winding bobbin drivn by a variable speed driving motor wherein the tension on the thread increases with increasing winding speed which comprises:

first means for determining the original length of thread on the cop prior to rewinding;

second means for continuously measuring the length of thread removed from the cop;

third means responsive to said first and second means to compute continuously from the original length and the measured length the residual length of thread remaining on the cop; and fourth means responsive to said third means and coupled to said motor to vary the speed of the motor in accordance with the residual length to maintain optimum winding speed and thread tension without causing thread breakage.

5. Apparatus as set forth in claim 4 wherein the first means includes additional means for determining the weight of the original thread.

6. Apparatus as set forth in claim 3 wherein the first means also includes computing means responsive to the weight of the original thread and a predetermined calculation factor length per thread weight to calculate the original thread length.

7. Apparatus as set forth in claim 4 further including a main station at which the spinning cop is disposed and an upstream station spaced from the main station which temporarily receives an additional spinning cop.

8. Apparatus as set forth in claim 7 wherein the main station contains a weighing cell and the upstream station contains an additional weighing cell.

* * * * *